United States Patent [19]

Wendt

[11] 4,391,171

[45] Jul. 5, 1983

[54] TRIM PRESS INCLUDING EJECTOR

[75] Inventor: Michael Wendt, Hope, Mich.

[73] Assignee: Lyle Development, Inc., Beaverton, Mich.

[21] Appl. No.: 196,207

[22] Filed: Oct. 14, 1980

[51] Int. Cl.[3] ..... B26F 1/02

[52] U.S. Cl. ..... 83/82; 83/97; 83/125; 83/135

[58] Field of Search ..... 83/97, 82, 81, 123–128, 83/135

[56] References Cited

U.S. PATENT DOCUMENTS 1,462,094 7/1923 Walsh ..... 83/127
1,736,958 11/1929 White et al. ..... 83/125
3,461,760 8/1969 Whitz ..... 83/81
4,158,539 6/1979 Arends et al. ..... 425/451.4

FOREIGN PATENT DOCUMENTS 47-22999 6/1972 Japan ..... 83/125

*Primary Examiner*—James M. Meister
*Attorney, Agent, or Firm*—John J. Swartz

[57] ABSTRACT

A trim press including relatively movable trim die assemblies for engaging opposite sides of a plastic sheet to sever articles integrally formed in a sheet of plastic. An article ejector is mounted on the moving die assembly. Mechanism is provided for moving one of the trim dies in a to-and-fro reciprocal path and amplifier mechanism is provided for moving the article ejector relative to the moving trim die.

4 Claims, 11 Drawing Figures

TRIM PRESS INCLUDING EJECTOR

FIELD OF THE INVENTION

This invention relates to a trim press for severing articles from a sheet of thermoplastic material in which articles have been differentially pressure formed and more particularly to a trim press including ejector mechanism for rapidly ejecting an article severed at a trim station.

BACKGROUND OF THE INVENTION

Apparatus, such as that disclosed in U.S. Pat. No. 3,664,791, granted to G. W. Brown on May 23, 1972, has been provided heretofore for successively delivering a heated thermoplastic sheet to a sheet heating station, then to a forming station at which opposed die parts engage the sheet to differentially pressure form three dimensional articles in the sheet, and then to a trim station at which the articles are severed from the sheet. U.S. patent application Ser. No. 142,241, filed by Gaylord W. Brown on Apr. 21, 1980, entitled High Speed Trim Press, discloses a trim press for severing articles, which have been differentially pressure formed in a thermoplastic sheet, from the thermoplastic sheet.

U.S. patent application Ser. No. 073,690, entitled Dynamically Balanced Trim Press, filed by Gaylord W. Brown on Sept. 10, 1979, now U.S. Pat. No. 4,313,358, which is incorporated herein by reference, discloses a reciprocally movable trim die assembly including hollow cylindrical die knives and an opposed reciprocally moving trim die having trim punches which move between remote positions in which the sheet is indexed to the trim station and sheet trimming positions, engaging opposite sides of the sheet, to trim articles positioned at the trim station. The latter mentioned patent application discloses articles ejectors mounted in the follow die punches for movement relative thereto between retracted positions received by the die punches, when the die assemblies are in the spaced apart positions, and advanced, ejector positions, projecting from the hollow punches after the articles are severed from the sheet.

The ejectors disclosed in the aforementioned patent application Ser. No. 073,690 are driven via a cam and cam follower assembly which essentially "hammers" the ejector to the projected, ejecting position. Such "hammering" causes substantial loading, which can have a dilatorious effect on the machine bearings.

The ejector disclosed in the aforementioned patent application Ser. No. 073,690 moves the severed part into an opening provided in the hollow trim die knife. It is important that the severed parts be ejected as rapidly as possible and removed from the trimming station so that the plastic sheet can be rapidly indexed to advance another part to the trim station. Accordingly, it is an object of the present invention to provide a trim press of the type described for severing three dimensional articles from a sheet including mechanism for more rapidly ejecting the article severed at the trim station.

It is another object of the present invention to provide trim press apparatus having relatively movable die parts which move between spaced apart positions and sheet trimming positions for severing articles from a plastic sheet including a variable speed reciprocally mounted article ejector which moves between a retracted position and an ejector position to more rapidly eject the severed articles and maximize the speed of operation.

Yet another object of the present invention is to provide a trim press of the type described including mechanism for moving one of the trim die parts through a predetermined reciprocal stroke and new and novel amplifier mechanism for moving an article ejector through a greater predetermined stroke to eject the article and move it from a position between the die parts to a position received by the opposing die part.

Still another object of the present invention is to provide a trim press of the type described including a drive member which moves in an endless path of travel, a coupling arm which couples the drive member to a first trim die to reciprocally move the trim die toward and away from an opposing die, an ejector mounted on the moving trim die, and apparatus, mounted on the coupling arm, for moving the ejector relative to the first trim die.

A further object of the present invention is to provide a trim press of the type described including drive mechanism for relatively moving opposing trim dies and amplifying mechanism mounted on the drive mechanism for moving an ejector, carried by one moving trim die, a distance greater than the distance which the one moving trim die moves to separate the part from the one moving trim die and move it toward the other trim die.

A still further object of the present invention is to provide a trim press of the type described including a rotatable drive member mounting an eccentrically driven pin, a coupling arm which couples the eccentrically moving pin to a trim die for reciprocally moving the trim die in a reciprocal path toward and away from an opposed die, an ejector movably mounted on the moving trim die, and apparatus for moving the ejector relative to the trim die including a second pin eccentrically mounted on the first mentioned eccentrically moving pin, a rocker arm pivotally mounted on the coupling arm, and a connecting rod coupling the second eccentric pin and the rocker arm.

It is another object of the present invention to provide a trim press including a movable trim die, an ejector mounted on the trim die for movement relative thereto, an eccentrically driven pin for moving the trim die, and a second eccentric pin, mounted on the first mentioned eccentric pin for moving the ejector mechanism relative to the trim die.

Other objects and advantages of the present invention will become apparent to those of ordinary skill in the art as the description thereof proceeds.

SUMMARY OF THE INVENTION

In a trim press for severing an article, which has been integrally formed in a thermoplastic sheet, from the sheet comprising: opposed, relatively movable trim die members which engage opposite sides of a sheet to sever an article from the sheet; drive mechanism for reciprocally moving at least one of the trim dies relative to the other; ejector mechanism mounted on the moving trim die for movement therewith and for reciprocal movement relative thereto; and coupling mechanism for reciprocally moving the ejector between a remote position and an ejector position engaging a trimmed article including amplifier mechanism mounted on the drive mechanism for relatively moving the ejector mechanism and the one moving trim die to separate the severed article and the one moving trim die.

BRIEF DESCRIPTION OF DRAWINGS

The present invention may more readily be understood by reference to the accompanying drawings in which.

DESCRIPTION OF THE PREFERRED EMBODIMENT

Figure 1:
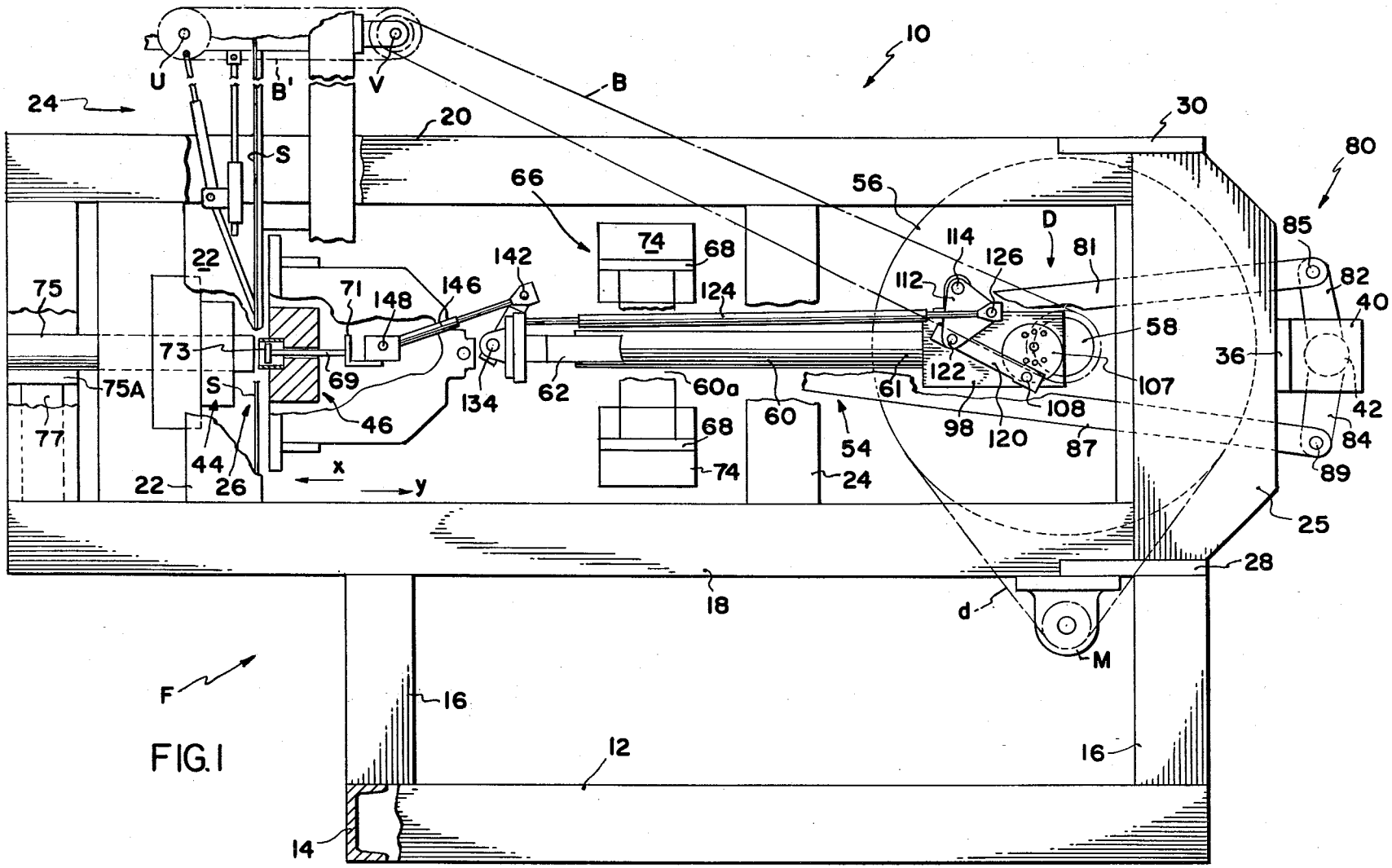
FIG. 1 is a side elevational view illustrating trim press apparatus constructed according to the present invention.

Trim press apparatus constructed according to the present invention generally designated 10, includes a frame, generally designated F, comprising laterally spaced apart rails 12 which are spanned by end frame members 14 and mount laterally spaced apart, upstanding posts 16. Mounted on the posts 16 is a pair of laterally spaced apart intermediate side rails 18 (FIGS. 1 and 2) and a pair of laterally spaced apart, upper side rails 20 spanned by laterally spaced apart pairs of vertical posts 22, 24 and 25. A transversely extending sill plate 28 couples the upper ends of end posts 16 to the intermediate side rails 18 and to the lower ends of vertical end post 25. A transversely extending upper plate 30 couples the upper rails 20 to the upper ends of the laterally spaced uptanding end posts 25. Disposed inwardly of the posts 25 are laterally spaced apart upstanding intermediate posts 32 and 34 spanning the coupling plates 28 and 30. A transversely extending crossmember 36 spans the post 32 and the adjacent post 25 whereas a transversely extending cross frame member 38 spans the upstanding post 32 and the adjacent post 25. The transversely extending frame members 36 and 38 mount pillow blocks 40 journaling a pivotal shaft 42 for the purpose to become more readily apparent hereinafter.

Figure 5:
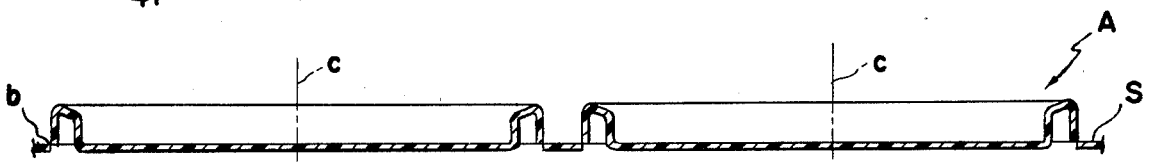
FIG. 5 is an enlarged sectional end view particularly illustrating a sheet of plastic having three dimensional articles thermoformed therein.

The trim press 10 is particularly adapted for severing articles, such as containers generally designated A (FIG. 5), which have been differentially pressure formed in a sheet S of thermoplastic material by thermoforming apparatus, such as that disclosed in U.S. Pat. No. 3,664,791 granted to G. W. Brown on May 23, 1972, which is incorporated herein by reference.

The articles A may suitably comprise thermoformed, thermoplastic lids for cups and the like, conventionally used in coffee vending machines.

As more particularly described in U.S. Pat. No. 3,664,791 and U.S. patent application Ser. No. 142,241, which are incorporated herein by reference the trim press includes a secondary stationary die assembly, generally designated 44, and a horizontally, reciprocally movable primary die assembly, generally designated 46 for engaging opposite sides of the sheet S and trim articles A from the sheet S. The die assemblies 44 and 46 are disposed on opposite sides of a trim station 26.

As described more particularly in applicant's copending U.S. patent application Ser. No. 142,241, the movable trim die assembly 46 includes a primary platen 48 having guide sleeves 50 slideably reciprocally mounted on a pair of laterally spaced apart guide rods 52 spanning the upstanding posts 24 and 22.

The secondary trim die assembly 44 includes a secondary platen, generally designated 45, including a vertical base 41 having an elongate slot 43 therethrough.

Mounted on the base 41 of the secondary platen 45 is a secondary trim die 47 including a plurality of laterally spaced apart apertures 49 therethrough in alignment with the slot 43. The apertures 49 are laterally spaced apart a distance equal to the distance between the centerlines c (FIG. 5) of the adjacent articles A formed in the sheet S. Mounted on the face of the stationary die 47 in alignment with each of the apertures 49 is a hollow, generally cylindrical, primary trim die knife 51 having an annular knife edge 53 for engaging one side of the sheet S along the circumferential border b of an article A formed in the sheet S. The trim die knife 51 includes a cylindrical passage 55 therethrough which receives the article A as it is being trimmed from the sheet S.

The primary platen 48 mounts a plurality of secondary, hollow, cylindrical trim die punches 57 having axes 59 axially aligned with the axes 65 of the secondary trim die knives 51. The primary trim die punches 57 each comprise a generally hollow cylinder having an annular knife edge 67 which bears against the opposite side of the sheet S and are received in sliding engagement by the stationary cylindrical die knives 51 after the articles A are servered from the sheet S. The movable die platen 48 includes a plurality of reduced diameter apertures **48*a* therethrough in axial alignment with the primary punches 57**.

As described in the aforementioned patent application Ser. No. 142,241, apparatus, generally designated 54, is provided for reciprocally moving the primary die assembly 46 in the direction of the arrows X and Y and includes an eccentric drive flywheel 56 mounted on a frame supported shaft 58. One end 61 of the drive rod 60 is pivotally coupled to the flywheel 56 in a manner to be described more particularly hereinafter and the opposite drive rod end 63 is coupled to a U-shaped yoke 62 which in turn is pivotally coupled via pivot pins 64 to mounting brackets **64*a* fixed to the die assembly 46. The flywheel drive shaft 58** is driven via a suitable frame supported electric motor M and gearing mechanism and drive belts.

Figure 2:
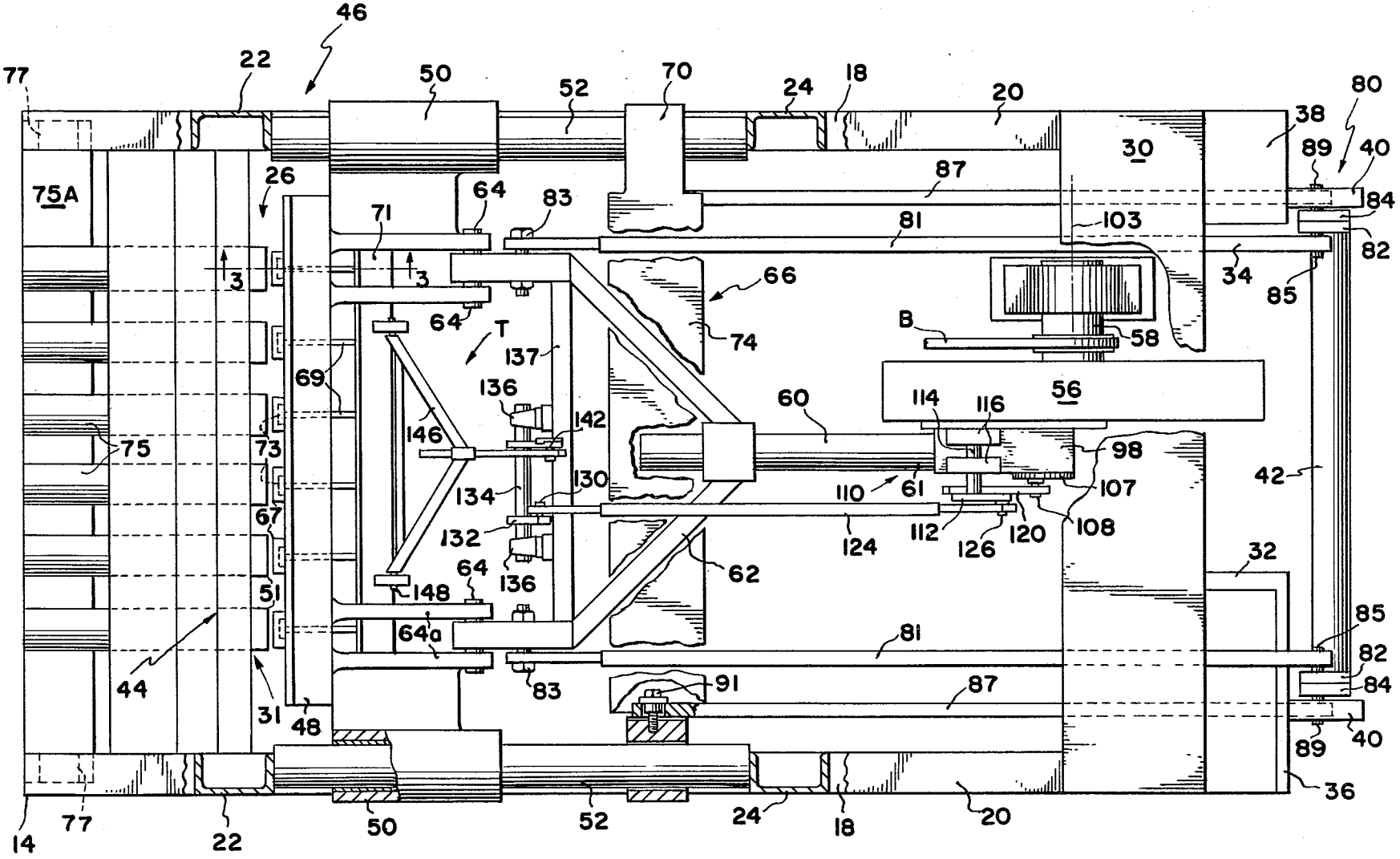
FIG. 2 is a top plan view thereof.
Figure 4:
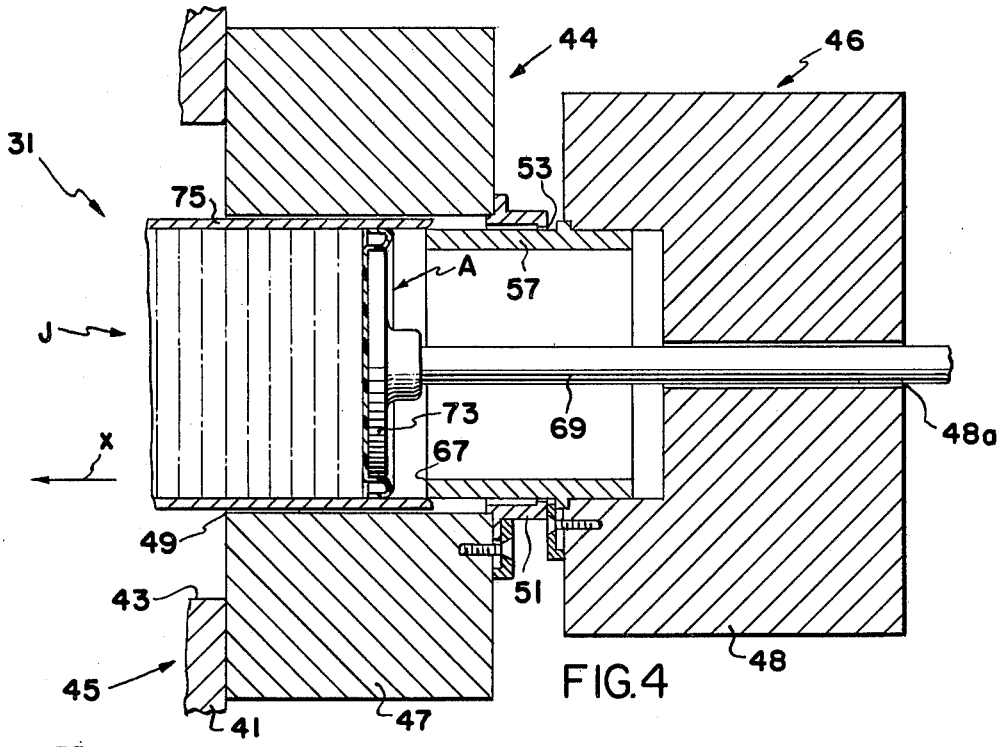
FIG. 4 is a greatly enlarged sectional side view, similar to FIG. 3, more particularly illustrating the die members in closed positions and ejector mechanism, constructed according to the present invention, in an ejecting position.
Figure 3:
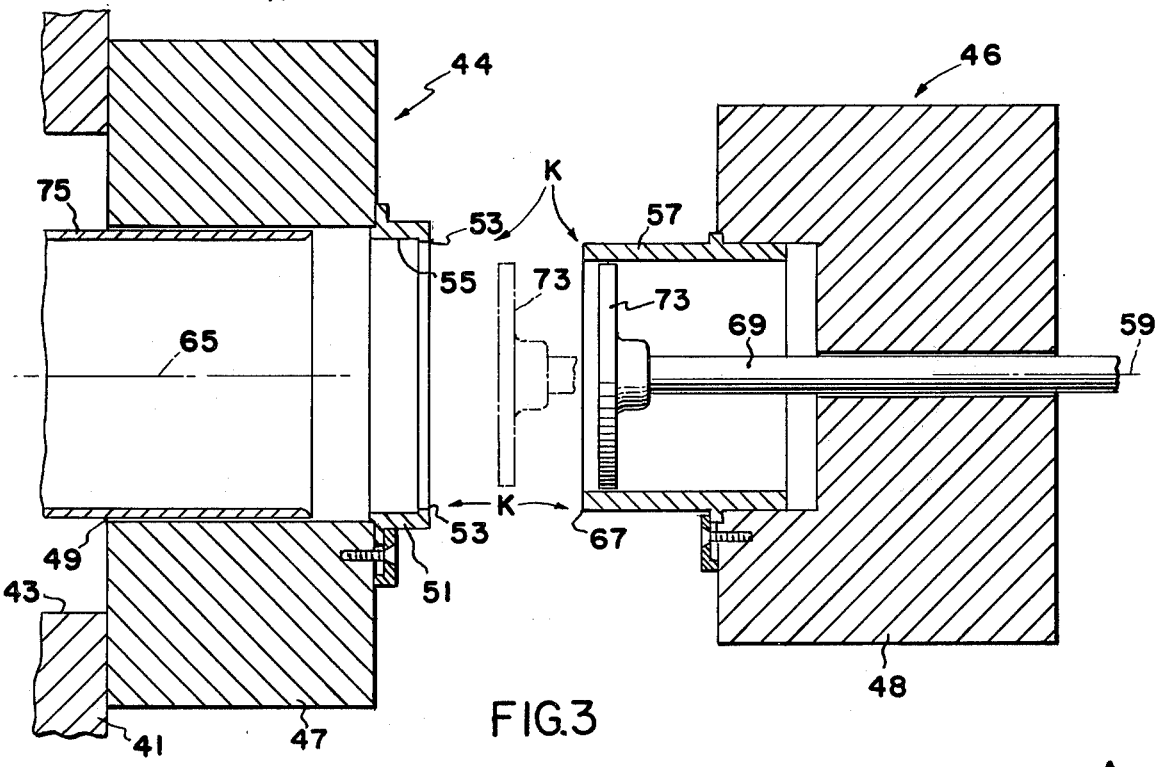
FIG. 3 is a greatly enlarged, sectional side view taken along the line 3—3 of FIG. 2, more particularly illustrating the die members in spaced apart positions and ejector mechanism in a removed position.

As the flywheel 56 rotates, the movable die assembly 46 is moved from the removed position, illustrated in FIGS. 1 and 3 to a closed position illustrated in FIG. 4 clamping the sheet S between the movable die assembly 46 and the stationary die assembly 44 to sever the articles A at the trim station 26 via trim knives, generally designated K. The sheet S is pinched and severed by the trim knives K and the stationary die 44.

Sheet feed apparatus, such as that designated 24 and disclosed in the aforementioned patent application Ser. No. 073,690, is provided for successively downwardly indexing a thermoplastic sheet S, having articles, such as containers A differentially pressure formed therein, in a vertical path to successively index articles A to a trim station 26 between the movable die assembly 46 and the stationary die assembly 44 when the movable die assembly 46 is in the removed position illustrated in FIGS. 1 and 3.

Apparatus constructed according to the present invention includes a counterbalance, generally designated 66, comprising transversely extending, upper and lower beams 68 spanned by bearing blocks 70 which receive the guide rods 52. Any one of a plurality of different size steel beams or the like 74 is removable mounted on each of the upper the lower beams 68 to adjust the weight of the counter balance 66 as needed. As illustrated in FIG. 1, the counter balance 66 receives the yoke drive rod 60 in the opening 60*a* defined by the upper and lower beams 68 and the bearing blocks 70. The weight of the counterbalance 66 is substantially equal to the weight of the primary assembly 46.

Apparatus, generally designated 80, is provided for moving the counterbalance 66 concurrently with movement of the primary die assembly 46, but in a direction opposite to the direction of the movement of the primary die assembly 46.

The counterweight moving apparatus 80 includes a pair of laterally spaced apart, upstanding links 82 fixed to the pivotal shaft 42 and pair of laterally spaced apart depending links 84 also fixed to the pivotal shaft 42. A pair of coupling rods 81 are pivotally connected at their forward ends, via pivot pins 83, (FIG. 2) to the primary die assembly drive yoke 62. The rearward ends of the drive rods 81 are pivotally coupled to the upper ends of upstanding links 82 via pivot pins 85. The rearward coupled ends of a pair of laterally spaced apart links 87 are pivotally coupled to the dependent links 84 via pivot pins 89 and the forward ends of the links 87 are pivotally coupled to the counterbalance 66 via pivot pins 91.

Trim press ejector mechanism, generally designated T, is provided for ejecting the articles A which have been trimmed from the sheet S by the die assemblies 44 and 46 at the trim station 26. The ejector mechanism T includes a plurality of ejector pins 69, fixed to an ejector platen, generally designated 71 (FIGS. 1 and 2) are received in the apertures 48*a* provided in the primary platen 48. An ejector plate 73 is mounted on each pin 69.

As described in the aforementioned patent application Ser. No. 173,690, article receiving apparatus generally designated 31, is provided for receiving the trimmed articles A and includes a plurality of generally cylindrical, hollow collector or receiver tubes 75 received in the secondary die passages 49. The tubes 75 are mounted on a transversely extending frame member 75A spanning laterally spaced apart posts 77 supported by side rails 18 and framemembers 14 and 16. As will be described more particularly hereinafter, the stroke of ejector pins 69 is of such length relative to the strokes of the primary die assembly 46 that the ejector plates 73 move the severed articles A into the collector tubes 75, as illustrated in FIG. 4 to nest the severed articles A in stacked relation with previously severed articles A and incrementally index the stacks J thus formed axially downstream, in the direction of the arrow X, along the receiver tubes 75.

THE DRIVE ASSEMBLY

A drive assembly, generally designated D, is provided for operating the sheet supply mechanism 24, primary trim die assembly 46, and the ejector mechanism, generally designated T, in timed relation and includes the transverse drive shaft 58. The shaft 58 mounts the flywheel drive pulley 56 which is drivingly coupled to an electrically energized motor M via a drive belt d. The sheet supply mechanism 24 is driven by a belt B trained around pulleys provided on shaft 58 and a frame supported shaft V as well as a belt B' coupling shaft V and a frame supported shaft U.

Figure 6:
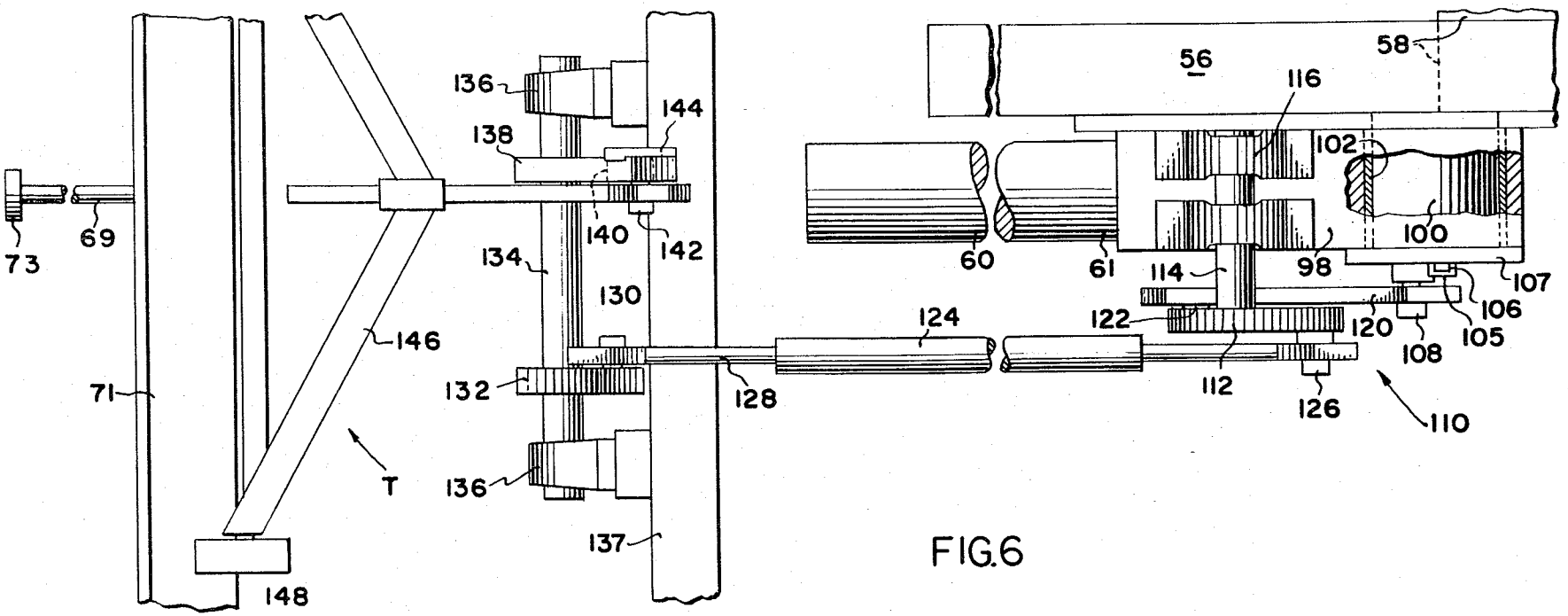
FIG. 6 is an enlarged top plan view of the ejector mechanism only.
Figure 7:
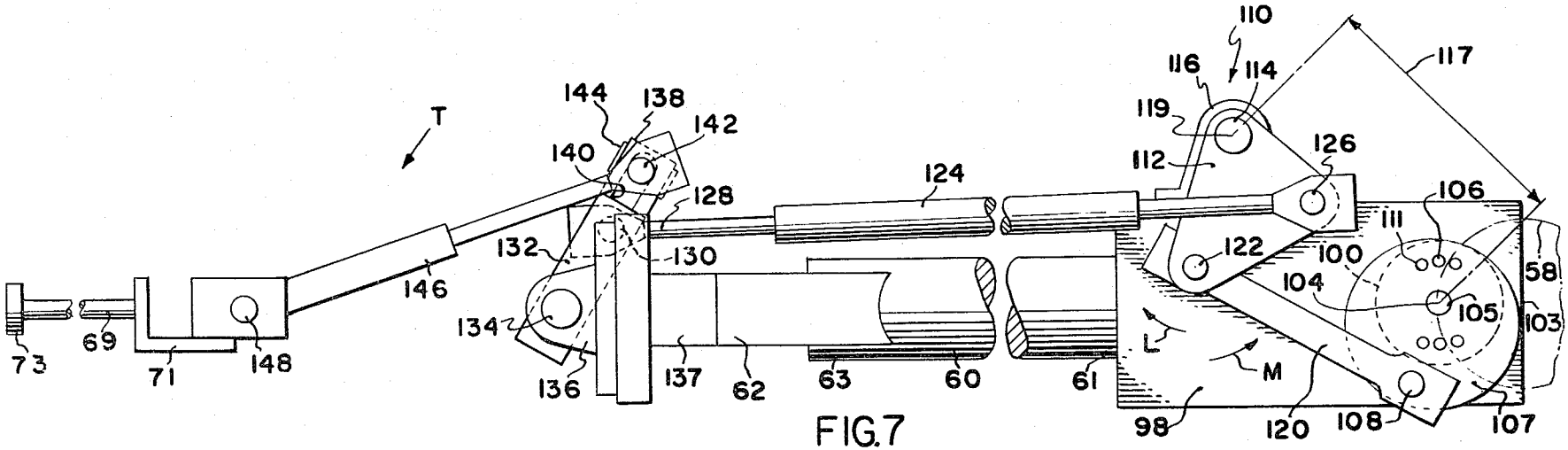
FIG. 7 is an enlarged, side elevational view of the ejector mechanism illustrated in FIG. 6.

The drive rod 60 for reciprocally driving the primary die platen 48 is fixed at one end 61 to a connector block 98 (FIGS. 6 and 7) journalled, via bushings 102, on a crank pin 100 which is eccentrically mounted on the flywheel drive pulley 56. The crank pin 100, which travels in an endless circular path g, moves forwardly and rearwardly through a distance or stroke h (FIGS. 7–11). The flywheel 56 rotates about the flywheel shaft axis 103 of the shaft 58. The axis 104 of the crank pin 100 is parallel to, but offset from the drive shaft axis 103. The rod 60 and yoke 62 move the secondary die platen 46 in a to-and-fro path having a stroke h.

A crank pin plate 107 is eccentrically mounted on the crank pin 100 via a bolt 105 and a pair of radially outer circumferentially spaced bolts 106 which are received in selected openings 111 provided in the plate 107 and are threadedly received by the crank pin 100.

Projecting axially outwardly from the crank pin plate 107 is a second eccentric pin 108 for a purpose to be immediately described. The degree of eccentricity of crank pin 108 relative to the crank pin 100 can be adjusted depending on the selected opening 111 in which the bolts 106 are positioned.

Apparatus is provided for moving the ejector platen 71 relative to the primary die assembly 46 and includes an amplifier device, generally designated 110, including a triangularly shaped rocker arm assembly 112, fixed to a rocker shaft 114 journalled in bearing blocks, generally designated 116, mounted on the platen driving connector block 98. The rocker shaft 114 oscillates about an axis 119. It should be noted that the distance 117 between the axis 104 of crank pin 100 and the axis 119 of rocker shaft 114 remains constant throughout the operation.

The rocker arm assembly 112 is moved in a to-and-fro direction, represented by the arrows L and M, via a connecting rod 120 which is pivotally coupled, at the rear end thereof, to the second eccentric pin 108 and, at the forward end thereof, to a pivot pin 122 fixed to the rocker arm assembly 112. The linkage system for driving the ejector platen 71 includes a connector bar 124 pivotally coupled to a pin 126 at the rearward end portion of the rocker arm assembly 112. The forward end 128 of the connecting rod 124 is pivotally coupled to a pin 130 mounted on an upstanding arm 132 fixed to a shaft 134 journalled in bearing blocks 136 which in turn are fixed to a crossbar 137 spanning the U-shaped yoke 62. A laterally spaced, slotted arm 138 is also fixed to the pivotal shaft 134 and includes a slot 140 which receives a pin 142 mounted on a slide nut 144 that can be vertically adjusted to position the pin 142 at any one of a plurality of selected vertical positions along the slotted arm 138. A yoke, generally designated 146, is pivotally mounted, at its rearward end, on the pin 142 and is pivotally coupled via pivot pins 148 to the ejector pin platen 17. If desired, a safety clutch (not shown) can be provided on the shaft 134 for interrupting forward movement of the yoke 146 in the event of a "jam up."

THE OPERATION

The operation may more readily be understood by reference to FIGS. 8–11. It will be assumed that a group of articles A, to be trimmed from the sheet S, are initially positioned between the die assemblies 44, 46 at the trim station 26 and the trim press is in the position illustrated in FIG. 8 in which the primary trim die assembly 46 is one-half the distance (i.e. 3 inches) between the fully retracted and fully advanced positions (½ the stroke h). At this time, the ejector platen 71 is in the fully retracted position, relative to the primary die assembly 46, in which the ejector plates 73 are received by the primary die punch members 57.

Figures 8, 9, 10, 11:
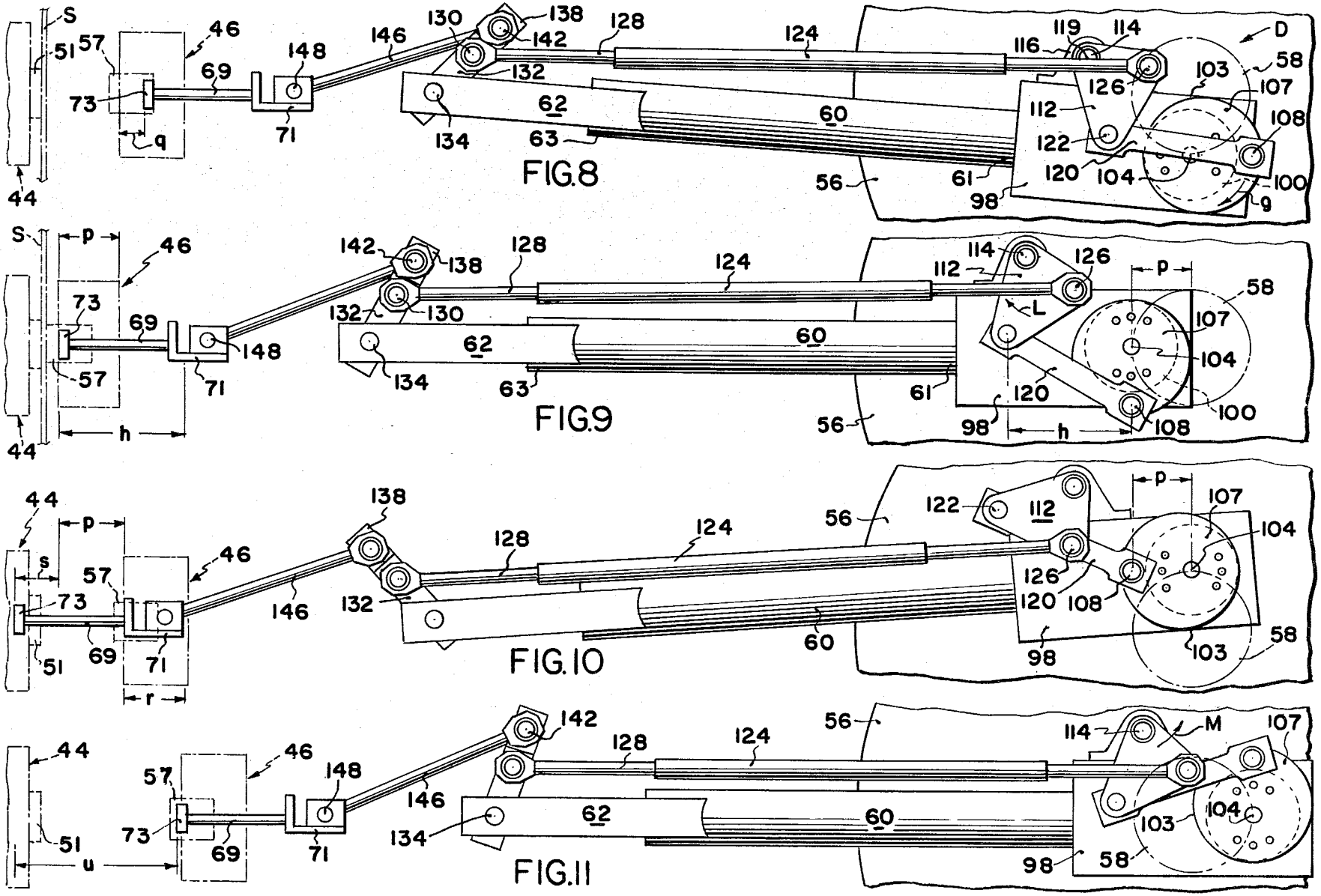
FIGS. 8–11 are side elevational views depicting the ejector mechanism and the moving trim die in various sequential positions during the operation.

As the operation continues, the flywheel 56 will rotate 90 degrees (¼ revolution) to the position illustrated in FIG. 9 to bodily forwardly advance the eccentric crank pin 100 a distance p (i.e. 3 inches or ½ the stroke h) to its "full forward" position. Since the primary platen 48 is coupled to the crank pin 100 via the coupling member 60 and the coupling block 98, the movable trim press platen 48 will also be moved forwardly a distance p to the fully advanced or fully forward position illustrated in FIG. 9, clamping the thermoplastic sheet S between the stationary die knives 51 and the primary die punches 57 to sever the articles A at the trim station 26 from the sheet S. At this time, as illustrated in FIG. 9, the ejector platen 71 has also bodily forwardly moved a distance p, which is approximately equal to ½ of the total stroke h, due to the forward movement of the pin 100. When the crank pin 100 moves from the position illustrated in FIG. 8 to the position illustrated in FIG. 9, the connecting rod 120 will partially swing the rocker arm assembly 112 and the pivot pin 126 mounted thereon about the rocker shaft axis 119 in the direction of the arrow L. When the rocker assembly pin 126 initially moves from the position illustrated in FIG. 8, the forward component of velocity of connecting pin 126 will be relatively small, however, with continued rotation, the forward component of velocity will increase and the forward movement of the rocker arm pin 126 will forwardly drive the connector rod 124 and ejector platen 71 a distance q (i.e. 1.5 inches) relative to the primary platen 48 to advance the ejector plates 73 into engagement with the severed articles A. Accordingly, as the machine parts move from the positions illustrated in FIG. 8 to the positions illustrated in FIG. 9, the primary platen 48 will bodily forwardly advance a distance p (3 inches) and the ejector platen 71 will concurrently bodily advance a distance p plus q (4.5 inches).

As the flywheel 56 continues to rotate another ¼ revolution to the position illustrated in FIG. 10, the trim press platen 48 will retract a distance p (3 inches) equal to one-half the total stroke h. Although the axis 104 of crank pin 100 has retracted a distance p, the eccentrically mounted pin 108 does not retract but does move upwardly to further forwardly rotate the rocker arm assembly 112 about the rocker shaft 114 in the direction of the arrow 1. As the pin 126 and the rocker arm assembly move to the positions illustrated in FIG. 10, the pin 126 will be moving forwardly with a maximum forward component of velocity and thus the rocker arm assembly 112 amplifies the forward movement of the eccentric pins 100 and 108.

The coupling rod 124 is thus forwardly driven to further advance the ejector platen 71 and ejector plates 73 a distance s (i.e. 2.5 inches) to the fully advanced ejector position illustrated in FIGS. 4 and 10 to move the severed articles A into the secondary die 45. From the position illustrated in FIG. 9 to the position illustrated in FIG. 10, the platen 48, in the example chosen, has rearwardly moved three inches and the ejector platen 71 is forwardly moved 2½ inches for a net difference of 5.5 inches.

As the flywheel 56 continues to rotate another 90 degrees to the position illustrated in FIG. 11, the crank pin 100 will now be fully retracted and thus the primary die assembly 46 will also be fully retracted. At this time the crank pin 100 will have retracted an additional distance r (i.e. 3 inches) equal to the distance p, and thus the primary die platen 48 will be retracted a distance r to its fully retracted position. The eccentric pin 108 is also retracted and will rotatably drive the rocker assembly 112 in the opposite direction, presented by the arrow M to move the ejector platen 71 a total distance u so that the ejector platen is in its rearwardmost position but not fully retracted within the primary die punch 67. As the rocker arm assembly 112 moves from the position illustrated in FIG. 10 to the position illustrated in FIG. 11, the pin 122 will include a rapid rearward horizontal component of velocity and thus the ejector pins and ejector platen 71 will rapidly retract to provide clearance for the sheet S to be indexed to position trailing articles A at the trim station 26.

In the illustrated example, as the press moves from the position illustrated in FIG. 10 to the position illustrated in rearwardmost postion and the ejector platen 71 has rearwardly moved a total distance u of 8¼ inches. The rocker arm assembly 112 thus also amplifies the rearward movement of the eccentric pins 108 and 100.

The sheet S will then be indexed downwardly to position another group of articles A at the trim station 26. The next 90 degree rotation of the flywheel 56 will return the parts to the positions illustrated in FIG. 8 and the operation will be repeated.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In a trim press for trimming articles, which have been differentially pressure formed in a plastic sheet, from the plastic sheet comprising:

a frame;

means for incrementally indexing said sheet of plastic to successively position articles at a trim station;

first and second trim dies mounted on said frame for relative movement toward and away from each other between spaced apart positions and closed positions in which the trim dies engage opposite sides of said plastic sheet to sever the articles from the sheet at said trim station;

means for reciprocally moving at least one of said trim dies toward and away from the other of said trim dies comprising:

a flywheel rotatably mounted about a first axis on said frame;

a first eccentric drive pin having a second axis radially offset from said first axis, mounted on said flywheel for bodily movement about a third axis;

first coupler means coupling said eccentric drive pin to said one trim die to reciprocally move said one trim die; and ejector means reciprocally mounted on said one trim die for movement relative thereto; and the improvement comprising:

means for moving said ejector means relative to said one trim die comprising:

rocker arm means mounted on said first coupler means for to-and-fro swinging movement;

a second eccentric pin, having a fourth axis, radially offset from said first, second and third axes, coupled to said first eccentric drive pin for bodily movement therewith; and connector means coupling said second eccentric drive pin to said rocker arm means to swing said rocker arm in said to-and-fro path;

said coupler means coupled to said ejector means and to said rocker arm means for reciprocally moving said ejector means relative to said trim die to separate severed articles at said trim station from said one trim die.

2. A trim press for severing an article, which has been integrally formed in a sheet, from said sheet comprising:

a frame;

first and second trim dies mounted on said frame for relative movement toward and away from each other between removed positions and trimming positions engaging opposite sides of a sheet disposed therebetween to sever an article from said sheet at a trim station, said dies in said removed positions being spaced apart a predetermined distance;

drive means movable between retracted and advanced positions;

first coupling means coupling said drive means to at least one of said trim dies to alternately move said one trim die forwardly said predetermined distance from said removed position to said forward position and rearwardly said predetermined distance from said forward position to said removed position;

ejector means mounted on said one trim die for reciprocal movement relative thereto between a retracted position removed from said sheet and an advanced ejector position projecting from said one trim die to eject an article severed at said trim station; and second coupling means coupling said drive means and said ejector means for moving said ejector means between said remote and said ejector positions, including amplifying means, mounted on said first coupling means for bodily movement therewith and for movement relative thereto, for alternately moving said ejector means forwardly a greater predetermined distance from said retracted position to said ejector position, and rearwardly said greater predetermined distance from said ejector position to said retracted position, so that said ejector means moves relative to said one trim die to separate the severed article and said one trim die;

said other trim die including a hollow trim die knife aligned with said opening in said other die; said one trim die comprising a male die punch which is received, in part, in said hollow trim die knife when said dies are in said trimming positions;

said drive means comprises a flywheel rotatable about a first axis on said frame; a first eccentric drive pin, having a second axis offset from said first axis, movable about a third axis offset from said first and second axes; a second eccentric drive pin, having a fourth axis offset from said first, second and third axes, coupled on said eccentric pin for movement therewith; said first coupling means being coupled to said first eccentric pin for movement therewith; said second coupling means comprising first connector means pivotally coupled to said second eccentric pin and pivotally coupled to said rocker means.

3. The trim press set forth in claim 2 including means adjustably mounting said second connector pin on said first connector pin to adjust the stroke on said ejector means.

4. A trim press for severing an article, which has been integrally formed in a sheet, from said sheet comprising:

a frame;

a first and second trim dies mounted on said frame for relative movement toward and away from each other between removed positions and trimming positions engaging opposite sides of a sheet disposed therebetween to sever an article from said sheet at a trim station, said dies in said removed positions being spaced apart a predetermined distance;

drive means movable between retracted and advanced positions;

first coupling means coupling said drive means to at least one of said trim dies to alternately move said one trim die forwardly said predetermined distance from said removed position to said forward position and rearwardly said predetermined distance from said forward position to said removed position;

ejector means mounted on said one trim die for reciprocal movement relative thereto between a retracted position removed from said sheet and an advanced ejector position projecting from said one trim die to eject an article severed at said trim station; and second coupling means coupling said drive means and said ejector means for moving said ejector means between said remote and said ejector positions including amplifying means, mounted on said first coupling means, for alternately moving said ejector means forwardly a greater predetermined distance from said retracted position to said ejector position, and rearwardly said greater predetermined distance from said ejector position to said retracted position, so that said ejector means moves relative to said one trim die to separate the severed article and said one trim die;

said drive means comprises a drive pin movable in a closed, 360 deg. path of travel to move said ejector means between said trim station and said retracted position at a maximum predetermined velocity; said amplifying means being responsive to movement of said drive pin to move said ejector means between said trim station and said advanced position at a greater predetermined maximum velocity.

* * * * *